United States Patent [19]

Roccaforte

[11] 4,155,445

[45] May 22, 1979

[54] DISPLAY BOX

[75] Inventor: Harry I. Roccaforte, Western Springs, Ill.

[73] Assignee: Champion International Corporation, Stamford, Conn.

[21] Appl. No.: 861,173

[22] Filed: Dec. 16, 1977

[51] Int. Cl.[2] ..... B65D 65/24

[52] U.S. Cl. ..... 206/45.14; 206/476; 206/486

[58] Field of Search ..... 206/45.14, 45.19, 277, 206/476, 486, 490, 491

[56] References Cited

U.S. PATENT DOCUMENTS

| | | | |
|---|---|---|---|
| 3,157,275 | 11/1964 | Tolaas | 206/45.14 |
| 3,292,777 | 12/1966 | Desmond | 206/45.14 |
| 3,378,137 | 4/1968 | Stone | 206/45.14 |
| 3,489,269 | 1/1970 | Rosenburg, Jr. | 206/45.14 |
| 3,642,125 | 2/1972 | Johnson | 206/491 |
| 3,746,156 | 7/1973 | Austin et al. | 206/45.14 |
| 3,819,035 | 6/1974 | Jaeschke | 206/45.14 |
| 3,887,067 | 6/1975 | Collura | 206/277 |
| 4,054,203 | 10/1977 | Farquhar | 205/277 |

FOREIGN PATENT DOCUMENTS

| | | | |
|---|---|---|---|
| 539776 | 4/1957 | Canada | 206/476 |

*Primary Examiner*—Herbert F. Ross
*Attorney, Agent, or Firm*—Evelyn M. Sommer

[57] ABSTRACT

A display carton for an elongated bottle of smaller length and width than the carton is characterized by upper and lower support structures for restraining lateral and longitudinal movement of the bottle within the carton. The upper structure is in the form of a transverse strut having a U-shaped cut-out corresponding in configuration, and adapted to engage, the cap of the bottle. The lower support structure includes a portion that is adhesively bonded to the inside of the back panel of the carton and is hingedly connected to an inclined support member having an aperture corresponding in configuration to the base portion of the bottle. The aperture has a V-shaped cut which serves the purpose of guiding and funneling the bottle into the carton as it is automatically loaded by conventional automatic loading equipment. Preferably, the front panel includes slanted shadow panels, for aesthetic purposes and to expose substantially the entire length of the elongated bottle.

7 Claims, 7 Drawing Figures

DISPLAY BOX

The subject invention relates to display cartons having internal panels that are glued in such a way to form a platform and a slanted end panel so that an object, such as an elongated bottle, can be automatically end loaded into the display carton at high speed.

Display cartons of the shadow panel type for small objects such as pharmaceuticals or chemicals are well known, and as an example, reference is made to applicant's United States Letters Patent No. 4,037,717 entitled "Display Carton" which issued on July 26, 1977, and which is assigned to the assignee of the subject application. U.S. Letters Pat. No. 4,037,717 discloses a display carton wherein substantially identical cushioning structures are provided at opposite ends of the carton to support and restrain the ends of the elongated bottle to be displayed away from the ends of the carton.

The subject invention relates to a new and improved display carton which includes different top and bottom internal support structures, the top support structure including a strut which extends across the width of the carton, intermediate the front and back panels thereof. The strut includes a suitable cut-out to engage one end of the elongated bottle to prevent lateral shifting thereof. The bottom internal structure comprises an extended panel including several portions, one of which is bonded to the inside surface of the back panel. Hingedly connected to the bonded back panel portion, and extending at an inclined angle relative to the base of the carton is a second panel portion which, in turn, is hingedly connected to a bottom closure tab. An aperture is provided between the back panel and the inclined panel, with the end of the aperture extending between the back panel and the inclined panel being V-shaped in configuration, while the opposite end of the aperture within the inclined panel is arcuate. By this arrangement, the V-shaped aperture guides and funnels the elongated object into the carton during an automatic loading operation, and thereafter intimately engages one end of the elongated object to restrain the object from lateral shifting within the carton.

Further objects and advantages of the invention will become apprent from a reading of the following detailed description taken in conjunction with the drawings in which.

Figure 1:
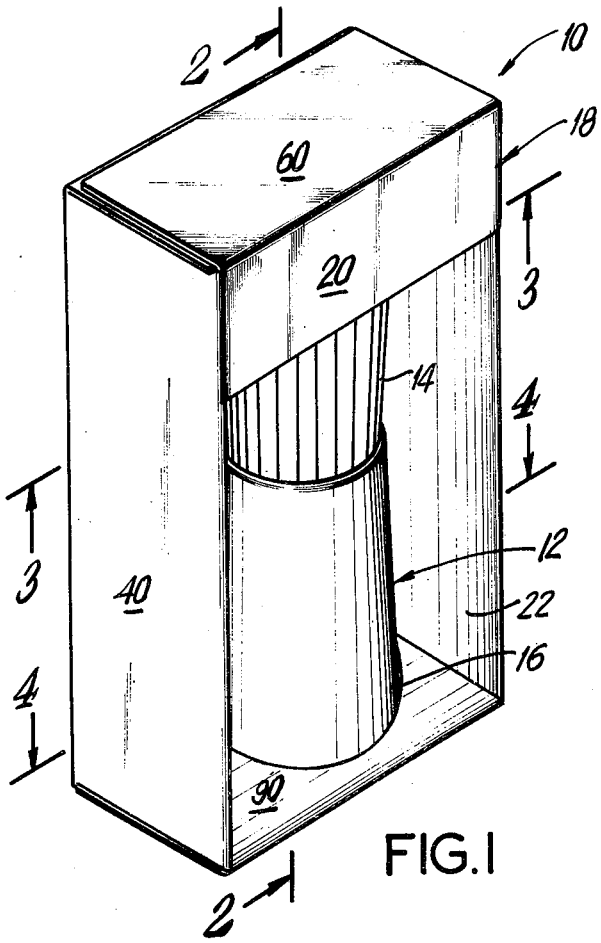
FIG. 1 is a perspective view of an assembled display carton containing an elongated bottle which embodies the present invention.
Figure 3:
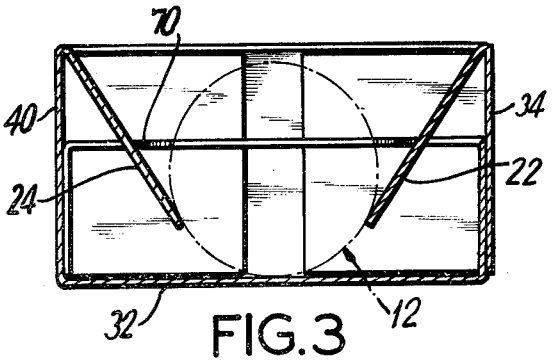
FIG. 3 is a cross-sectional view taken along line 3—3 in FIG. 1;.
Figure 4:
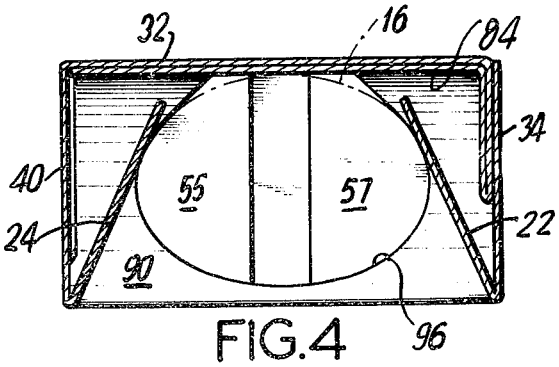
FIG. 4 is a cross-sectional view taken along line 4—4 in FIG. 1.

As shown in FIG. 1, the display carton of the subject invention is generally designated by the numeral 10 and is provided for holding a bottle 12, during shipment and for display, which normally contains a cosmetic substance or pharmaceutical. The length of the bottle 12 is less than the length of the carton 10, and the width of the bottle 12 is likewise less the width of the carton. Bottle 12 is shown as being shaped with an oval base portion 16 (see FIG. 4) which tapers inwardly to a generally circular section near the top, as shown in FIG. 3. The cap portion 14 of the bottle has a larger diameter at the top thereof, then at the bottom.

Referring to FIGS. 1 through 4, the front panel 18 includes an upper restraining section 20 which may serve to hold graphics or other aesthetic features for the display carton, as well as two shadow panels 22 and 24. The shadow panels may also serve to hold graphics or other aesthetic features for the display carton.

Figure 5:
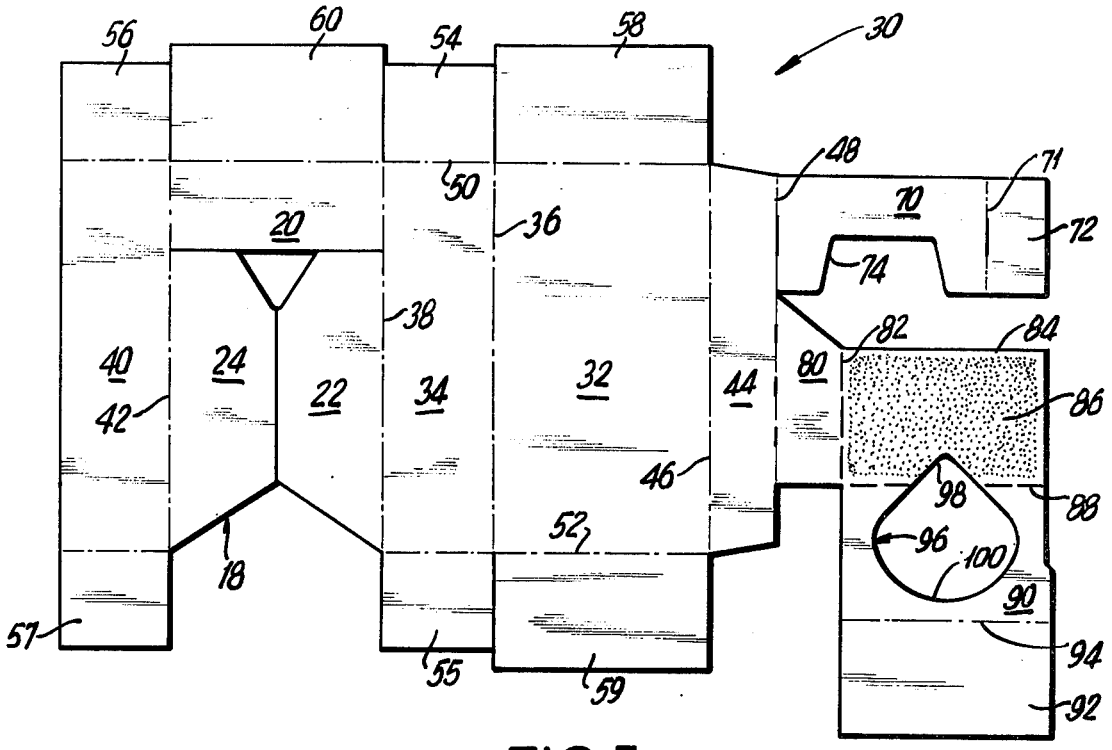
FIG. 5 is a plan view of a blank adapted to be erected into the display carton as shown in FIGS. 1 through 4.

The blank for forming the display carton of the subject invention is illustrated in FIG. 5 and is preferably made of a sheet-like material, such as foldable paperboard. The foldable blank is designated by the numeral 30 and includes a back panel 32 that is generally rectangular in configuration and is hingedly connected to a first side panel 34 along fold line 36. In turn, front panel 18 is hingedly connected to first side panel 34 along hinge line 38, while a second side panel 40 is hingedly connected to the front panel along fold line 42. A conventional manufacturer's joint is formed by means of a manufacturer's glue flap 44 which is hingedly connected to the back panel 32 along hinge line 46. A vertically extending hinge line 48 hingedly connects the manufacturer's glue flap to the top and bottom internal support structures, as more specifically set forth below. It is noted that the four panels 32, 34, 18 and 40 are connected by the vertically extending hinge lines 36, 38, and 42, and are defined along the top and bottom edges by parallel fold lines 50 and 52, with the four panels being foldable together into a rectangular tubular relationship which is held in place by a conventional manufacturer's joint, including glue flap 44. For closing the opposite ends of the display carton, side panels 34 and 40 have end closure flaps hingedly attached at the top and bottom edges thereof along the fold lines 50 and 52, with said end flaps being designated by the numerals 54 through 57, inclusive. Back panel 32 includes end closure flaps 58 and 59, while hingedly attached to the top of the front panel 18 along fold line 50 is end closure flap 60 which also forms a part of the top end closure of the erected display carton.

Figure 6:
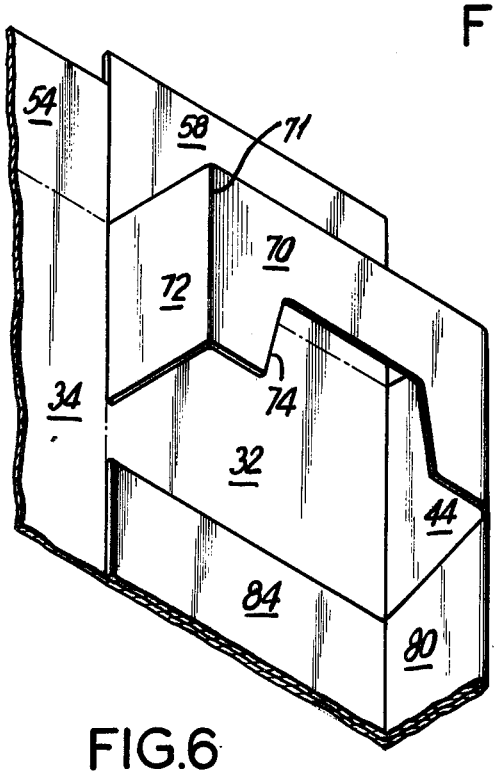
FIG. 6 is a perspective view of the upper strut support structure of the display carton illustrating the relationship of the various parts thereof.

The top internal support or platform for restraining the cap 14 from lateral movement within the erected carton is hingedly connected to the manufacturer's glue flap along hinge line 48, and includes a strut 70 to which is hingedly attached as at 71 to tab portion 72. Strut 70, as shown in FIG. 6, extends across the entire width of the carton and includes a U-shaped cut-out 74 corresponding in configuration to the configuration of the cap 14. The width of the manufacturer's glue flap 44 between the hinge lines 46 and 48 is substantially equal to the width of the tab portion 72. Furthermore, the widths of the manufacturer's glue flap 44 and tab portion 72 are less than the widths of the side panels 34 and 40 whereby, in the erected condition of the display carton, the strut 70 extends parallel to and intermediate the front and back panels of the erected carton. This is particularly illustrated in FIGS. 2 and 3.

Figure 2:
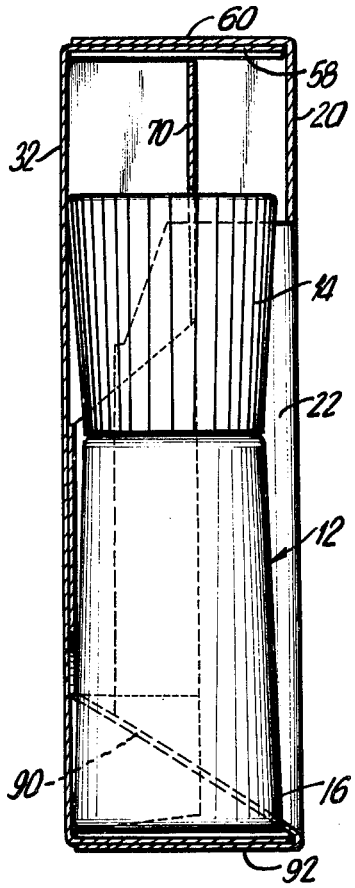
FIG. 2 is a cross-sectional view taken along line 2—2 in FIG. 1.
Figure 7:
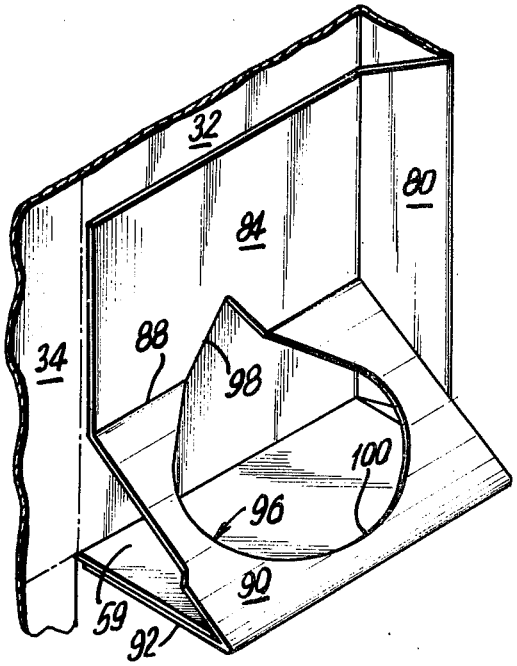
FIG. 7 is a perspective view of the bottom retaining panel structure of the subject invention, with the remainder of the carton broken away.

The bottom internal support structure includes a carrier panel 80 which is hingedly connected to the manufacturer's glue flap 44 along hinge line 48, while its opposite end is hingedly connected along hinge line 82 to a first panel 84. Panel 84 is coated with an adhesive material 86 to define a glue panel, with one end of said glue panel being hingedly connected along fold line 88 to a second panel portion 90 which, in the erected condition of the carton, defines an inclined support panel as shown in FIGS. 2 and 7. A bottom closure tab portion 92 is hingedly connected to the inclined support panel 90 along fold line 94. As shown in FIG. 5, an aperture 96 is provided in the lower support structure, and more particularly, is configured to include a V-shaped portion 98 that extends between the inclined support panel 90 and the adhesive glue panel 84. Opposite said V-shaped cut-out and wholly disposed within the inclined support panel 90 is an arcuate portion designated by the numeral 100. The specific configuration of the aperture 96, including the V-shaped cut-out portion 98, is operative to guide and funnel the elongated bottle into the erected carton during the automatic loading thereof, and in the final configuration is adapted to engage the base 16 of the elongated bottle to prevent lateral shifting thereof. This structure is illustrated with the strut 70 extending parallel to, and intermediate, the front and back panels of the display carton. In this position, the strut 70 engages the cap portion 14 of the elongated bottle in the U-shaped cut-out 74, and prevents lateral shifting of the elongated bottle within the carton.

As illustrated in FIG. 7, in the erected carton, the glue panel 34 is adhesively bonded to the inside of the back panel 32, and the inclined support panel 90 extends at an angle to the bottom closure of the carton.

Following the automatic erection of the carton to generally tubular configuration, and with the top closure flaps bonded in position, and with the inner strut 70 extending across the width of the carton, the elongated bottle is automatically loaded into the tubular carton and is prevented from moving to the top of the carton by virtue of the inner strut 70. Next, the bottom support structure is folded and bonded into position thereby resulting in the elongated bottle being engaged at its upper and lower ends, after which the bottom closure of the display carton is bonded to complete the packaging of the display carton. In the final erected condition, the upper and lower support structures prevent sideways or lateral movement of the elongated bottle within the carton during shipment and display.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

What is claimed is:

1. A display carton for an elongated bottle having at one end a cap, while the other end thereof is a closed base portion, said carton having a front panel, a back panel, a first side panel hingedly connected along its lateral ends to said front and back panels, a second side panel hingedly connected along one lateral end thereof to said front panel, and a glue panel hingedly connected to one lateral end of said back panel, said panels being arranged in a generally rectangular configuration, with end flaps closing the top and bottom ends thereof, the width and length of the carton being greater than the width and length of said elongated bottle, said carton comprising:

a top internal support structure including a strut hingedly connected at one lateral end to said glue panel, and having a U-shaped cut-out along the bottom edge of said strut, the base of said U-shaped cut-out engaging the top of the cap portion of the elongated bottle, and a tab member hingedly connected to the other lateral end of said strut member, said tab member and said glue panel having widths less than that of said side panels such that said strut extends across the width of the carton, substantially equidistant from and parallel to said front and back panels in such manner as to positively engage the cap and thereby prevent lateral movement thereof; and a bottom internal support structure including a first portion adhesively bonded to the inside of the back panel, an inclined portion hingedly connected to said first portion and having a central aperture corresponding in configuration to the base of the elongated bottle, and a closure tab portion hingedly connected to said inclined portion and contiguous with the bottom closure of the carton, with the distance between the closure tab portion of the bottom internal support structure and the base of the U-shaped cut-out in the strut substantially corresponding to the length of the elongated bottle to prevent longitudinal shifting of the bottle within the display carton.

2. A display carton for an elongated bottle as in claim 1 wherein said central aperture also extends into the first portion of the bottom internal support structure.

3. A display carton for an elongated bottle as in claim 2 wherein the end of the aperture extending between the first and second portions is V-shaped in configuration, whereas the opposite end of said aperture, as disposed in the inclined portion, is arcuate.

4. A display carton for an elongated bottle as in claim 1 wherein said front panel includes inwardly directed shadow panels for forming a shadow box configuration.

5. A blank made of paperboard and adapted to be folded into a display carton of generally rectangular and tubular shape for accommodating an elongated bottle having at one end a cap, while the other end is a closed base portion, with the width and length of the erected display carton being greater than the width and length of the elongated bottle, comprising:

a substantially rectangular sheet of said paperboard, said sheet having opposed vertical lateral edges and opposed horizontal top and bottom edges, the length of the blank between said top and bottom edges thereof being greater than the length of said elongated bottle;

five vertically spaced parallel hinge lines intermediate the lateral edges thereof defining a pair of said walls, a front panel, a back panel, a manufacturer's glue flap, and top and bottom internal support structures;

said side walls, and said front and back panels having end closure flaps hingedly attached to the top and bottom edges thereof along said top and bottom horizontal edges;

said top internal structure being hingedly connected along a vertical hinge line to said glue flap and including a strut portion to which is hingedly connected a tab portion, said strut portion including an inverted U-shaped cut-out corresponding in configuration to the cap portion of the elongated bottle, said tab member and said manufacturer's glue flap each being of a width substantially equal to one-half the width of said side panels such that when the carton is erected said strut extends across the width of the carton substantially equidistant from and parallel to said front and back panels in spaced apart relationship for positively engaging the cap to prevent lateral movement thereof; and said bottom support structure including a carrier panel hingedly connected along a vertical hinge line to said manufacturer's glue flap, along one edge, and hingedly connected along the opposite edge to a first glue panel, the latter being hingedly connected along a generally horizontal hinge line to an inclined support panel structure for the bottom support panel, said glue panel and said inclined support panel including an aperture corresponding in configuration to the base of the elongated bottle, and a closure tab portion hingedly connected along a generally horizontal fold line to said inclined support panel, with the vertical distance between the base of the U-shaped cut-out in the strut and the bottom horizontal edge substantially corresponding to the length of the bottle to prevent longitudinal shifting of the bottle within the erected carton.

6. A blank made of paperboard and adapted to be folded into a display carton of generally rectangular and tubular shape for accommodating an elongated bottle as in claim 5 wherein said aperture is generally V-shaped as extending between said glue panel and said inclined support panel, and is of arcuate shape within said inclined support panel.

7. A blank made of paperboard and adapted to be folded into a display carton of generally rectangular and tubular shape as in claim 5 wherein said front panel includes hingedly connected shadow box flap portions.

* * * * *

UNITED STATES PATENT AND TRADEMARK OFFICE

CERTIFICATE OF CORRECTION

PATENT NO. : 4,155,445

DATED : May 22, 1979

INVENTOR(S) : HARRY I. ROCCAFORTE

It is certified that error appears in the above-identified patent and that said Letters Patent are hereby corrected as shown below:

In Column 4, line 50, delete "said" and insert in lieu thereof -- side --.

Signed and Sealed this

*Twenty-second* Day of *April 1980*

[SEAL]

*Attest:*

SIDNEY A. DIAMOND

*Attesting Officer*

*Commissioner of Patents and Trademarks*